US006021659A

United States Patent [19]

Russell

[11] Patent Number: 6,021,659

[45] Date of Patent: Feb. 8, 2000

[54] ROTARY BENDING TOOL HOLDER

[75] Inventor: Robert L. Russell, Frankfort, Ill.

[73] Assignee: Power Brake Dies, Inc., South Holland, Ill.

[21] Appl. No.: 09/291,236

[22] Filed: Apr. 13, 1999

[51] Int. Cl.[7] ..... B21D 37/04

[52] U.S. Cl. ..... 72/481.7; 72/481.1; 72/481.6; 72/482.5

[58] Field of Search ..... 72/481.1, 481.6, 72/481.7, 481.8, 481.9, 482.5

[56] References Cited

U.S. PATENT DOCUMENTS

| | | | |
|---|---|---|---|
| 2,781,016 | 2/1957 | Livermont | 72/481.7 |
| 4,322,994 | 4/1982 | Muhr et al. | 72/481.7 |
| 4,535,619 | 8/1985 | Gargrave | 72/481.7 |
| 5,341,669 | 8/1994 | Katz | 72/387 |
| 5,361,620 | 11/1994 | Meadows | 72/387 |
| 5,404,742 | 4/1995 | Wilson et al. | 72/387 |

*Primary Examiner*—David Jones
*Attorney, Agent, or Firm*—McCaleb, Lucas & Brugman

[57] ABSTRACT

A rotary bending tool holder, particularly useful in a press brake type press, which embodies a two piece holder, namely a main body and clamp; usually attached to the moveable ram of the press brake. A rotary bending tool used with the holder is provided with elongated rectangular keyway slots along opposite sides which are aligned to received opposing tabs or keys engageable with such slots. One key is formed on the clamp of the holder while the other key is formed on the main body of the holder. Once positioned in the holder, the clamp is tightened to engage its associated key in one of the slots of the bending tool. This action causes the other key on the holder body to engage the other slot of the bending tool. At the same time opposing surfaces on the holder body and bending tool, located at the same distance from the center line of the tool holder engage to precisely align the center of the rotary head on the center line of the holder and press head.

6 Claims, 5 Drawing Sheets

FIG. 4
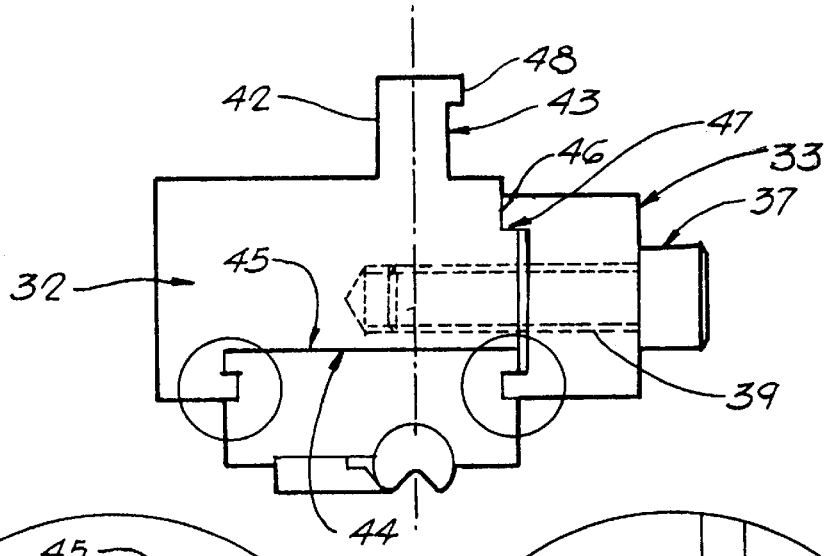
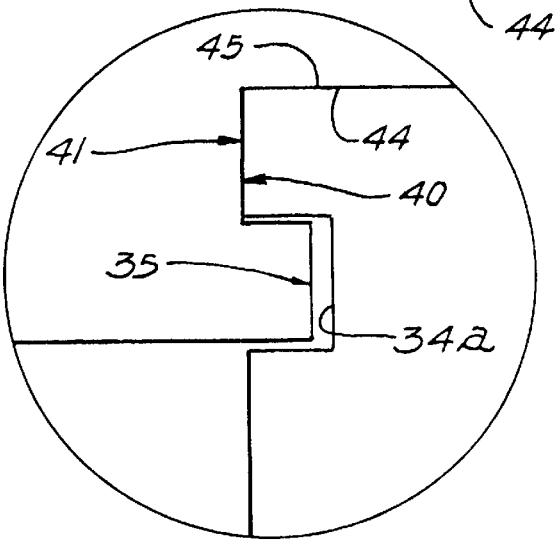
FIG. 4a
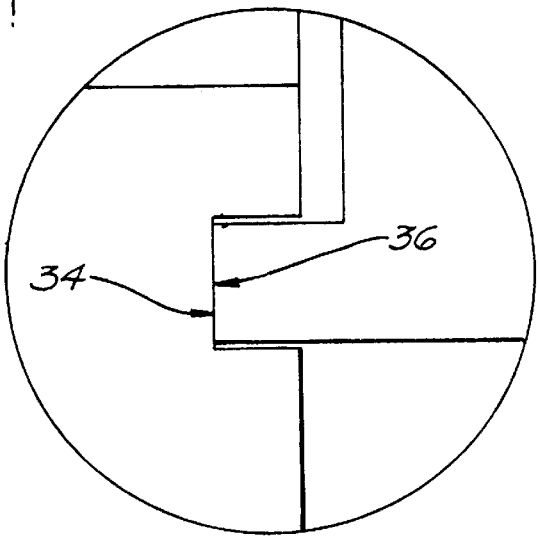
FIG. 4b

ROTARY BENDING TOOL HOLDER

This invention relates generally to the art of forming metal and more particularly to novel means for positively securing a rotarybending tool in precise operating position.

BACKGROUND OF THE INVENTION

A commonly used rotary bending tool of the type with which the present invention is particularly useful is described in U.S. Pat. No. 5,341,669, issued Aug. 3, 1994. According to recognized practice a rotary bending tool of this type is frequently used in a brake type press where forming action of the bending tool involves a combination of rotation and translation movements.

Such bending tools normally are held in a tool holder by machine screws inserted into bored or tapped aligned bores in the bending tool and tool holder. Great care must be taken to insure that a bending tool cut to a desired length (depending on the press involved) fits the press so that mounting holes in the bending tool unit align properly with corresponding bored and tapped holes in the tool holder.

A precision keyway is usually cut in the tool holder to which the bending tool is to be attached. Any key fitted into such a keyway must be secured positively to avoid any possibility of falling out during operation which could result in serious damage to the forming die, the press, and likely the operator.

Rotary benders conventionally come in several sizes for use with work materials having a wide range of thicknesses. However, the bending tools are quite limited to maximum lengths. Thus when used in a press brake it is often necessary to abut several short bending tool sections together in order to achieve the overall length required. Such use of several short tool lengths further compounds the problem of maintaining close tolerances necessary to mate the mounting holes in the bending tool with the mounting holes in the tool holder. This problem of hole alignment is further complicated by the many different hole patterns used in rotary benders, depending on the overall length of the bender unit. Thus for instance a tool 24" long cannot be replaced by two 12" pieces, because of hole pattern differences. It is to be noted that currently 36 inches is the maximum length available for rotary benders of larger sizes. Smaller sizes most commonly used are only available in 24 inch maximum lengths. The most common length of press brake application is twelve feet.

BRIEF SUMMARY OF THE INVENTION

This invention is directed to an improved and simplified holder for rotary bending tools and comprises a dual element combination of a base member and a clamp which present a pair of opposingly aligned keys or tabs designed to enter similarly aligned keyways formed in opposite sides of a rotary bending tool saddle block. The clamp is moveable relative to the base member whereby the key or tab of the clamp engages one end of the bending tool saddle block to hold the same and cause precision surfaces at the other end of the bending tool and the tool holder to interengage and locate the bending tool at a precise predetermined location in the holder which in turn is aligned to position the tool alignment with the center line of the tool's actuator, such as a press brake.

In light of the aforenoted problems it is a major object of this invention to provide an improved and novel precision rotary tool holder capable of receiving rotary bending tools of any length.

It is a further object of this invention to provide a novel rotary tool holder which precisely accepts and holds rotary bending tool units of various lengths without regard to matching mounting holes of the tool with mounting holes in the tool holder.

Still another important object of this invention is to provide a new and improved holder for rotary bending tools, which is simple to operate and which eliminates the need to maintain an inventory of replacement tool units of various sizes and lengths because of different mounting hole locations.

Having described this invention, the above and further objects, features and advantages thereof will be apparent to those skilled in the art from the following detailed description of preferred and modified embodiments illustrated in the accompanying drawings.

IN THE DRAWINGS

FIG. 4 is an end elevational view of the assembled rotary bending tool and tool holder shown separated in FIG. 3;

FIG. 4A is an enlarged partial elevational view detailing the left hand key and keyway relationship shown in FIG. 4;

FIG. 4B is another end elevational view and enlarged elevation, similar to FIG. 4A, detailing the encircled area indicated on the right hand side of FIG. 4;

DESCRIPTION OF THE PREFERRED EMBODIMENT

Figure 1:
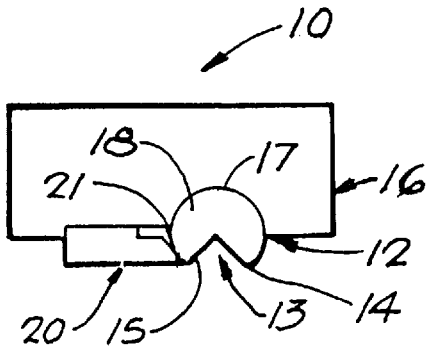
PRIOR ART FIG. 1
FIG. 1 is a end elevation of a conventional, rotary bending tool, popularly known in the prior art.
Figure 2:
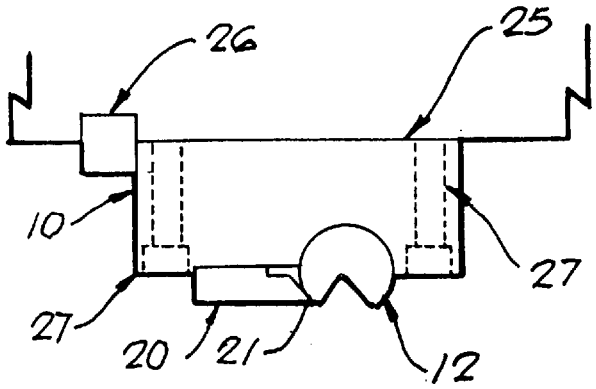
PRIOR ART FIG. 2
FIG. 2 is another end elevational view of the rotary bending tool of FIG. 1, but showing such tool mounted in a conventional tool holder according to prior art practice.

Turning now to the features of a preferred embodiment, illustrated in the drawings, initial reference is made to FIGS. 1 and 2.

Shown in FIG. 1, is a representation of a prior art rotary bending tool 10, according to above identified U.S. Pat. No. 5,341,699.

Bending tool 10 comprises a rotary head 12 having a substantially V-shaped recess 13 extending radially inwardly along the full length of head 12. The angle between the two planar arms or faces 14 and 15 of the recess is generally in the order of 90°. Head 12 is mounted in a saddle block 16 formed with a semi-cylindrical bearing surface 17, receptive of the mating body 18 of the rotary head 12. Surface 17 supports and embraces about one half of the circumference of body 18.

A retaining key 20 is attached to the saddle block in known fashion so that a sloping lead face 21 thereof underengages the bending head 12, holding it in position in the saddle. Suitable provision is made to position key 20 relative to bending head 12 which affords bearing play for the rotary bending head.

In FIG. 2 the prior art bending tool 10 is shown mounted on the underside of a known and conventional tool holder or die set 25. A precision cut keyway receptive of a locating key 26 serves to positively locate tool 10 which has bored or tapped holes receptive of machine screws 27 for securing the bending tool 10 to holder 25. Importantly, key 26 must be secured in place to prevent its falling out of the keyway.

Figure 3:
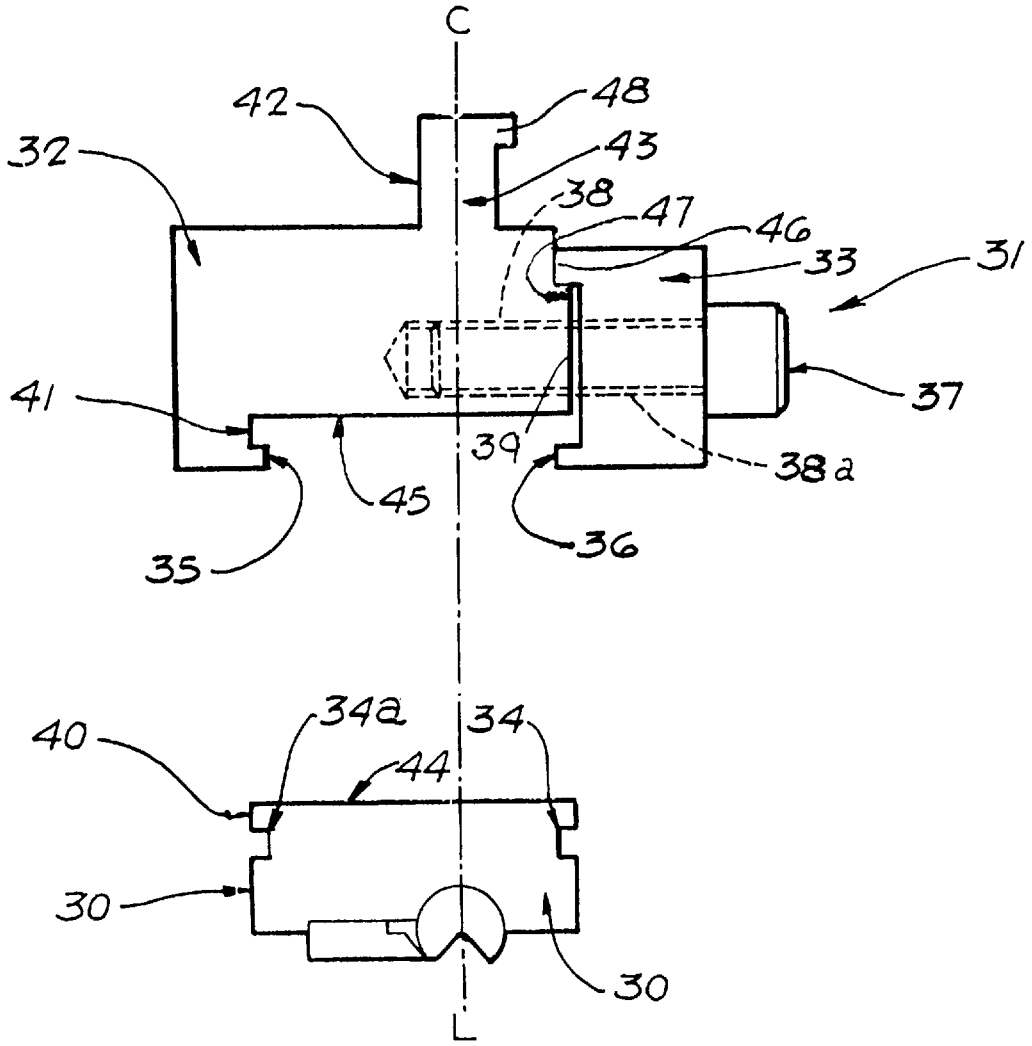
FIG. 3 is an end elevational view of a rotary bending tool and tool holder therefor, according to this invention.

FIG. 3 shows a modified rotary bender assembly 30 associated with a novel tool holder 31 according to this invention. This holder is made up of two main pieces, namely a main base 32 and a clamp 33.

The precision rotary bender 30 used with this invention is made with two aligned rectangular slots 34, 34*a* formed in opposite sides of the bender. These slots extend the full length of the tool and freely and loosely fit over associated retaining tabs 35, 36 formed in holder base 32 and clamp 33, respectfully.

A machine bolt 37 threads into a bore 38 extending laterally into one side 39 of the holder body 32. Bolt 37 also passes through a coaxial bore 38*a* which provides clearance for bolt 37 and extends through clamp 33.

When bolt 37 is tightened, clamp 33, moves toward holder body 32 causing the retaining tab 36 to engage the bottom face of slot 34 in the bending tool. The clamping force thus securely positions and holds the bending tool in holder assembly 31. In this regard, it is to be noted (see FIG. 4*a*) that the surface 40 of the bending tool is forced tightly against surface 41 of the holder body 32.

Surface 41 is cut precisely at the same distance from the center line of the bending tool as surface 40 is. These two dimensions are held at very close tolerances along with the surface 42 of a tang 43, by which the holder 31 is connected to a press brake. This insures that the entire assembly (bending tool and holder) is held at a precise location on the center line of the press indicated at C-L, FIG. 3.

With this arrangement holder 31 may slidably receive the bender of FIG. 3 from either end and once in proper position the bender is securely clamped in place as described above. At this juncture in the installation procedure, the bending tool and holder may not be fully seated, since there is likely to be space between the top surface 44 of the tool and the opposing surface 45 of the holder. However, after the first hit or blow of the press these two surfaces close and provide metal to metal contact as shown in FIG. 4. It will be noted that surfaces 40 and 41 are also fully seated (see FIG. 4A).

Pressure exerted by the clamp between surfaces 34 and 36 insures that surfaces 40 and 41 remain seated and perfectly aligned.

It can clearly be seen from the enlarged views 4*a* and 4*b*, that there is ample clearance between the tool holder and the bending tool slot 34*a*, as well as the clamp tab 36 to afford easy loading and removal of single or of multiple lengths of bending tools. Additionally, there is ample penetration of the holder tabs 35 and 36 into slots 34, 34*a* to prevent the bending tools from falling out of the holder during loading and unloading procedures.

The clamp 33 is supported by an upper tab 46 and a mating shoulder surface 47 cut into the holder (see FIG. 3). This arrangement provides support to prevent the bending tool from falling at those times when bolts 37 are in a loosened state.

Figure 5:
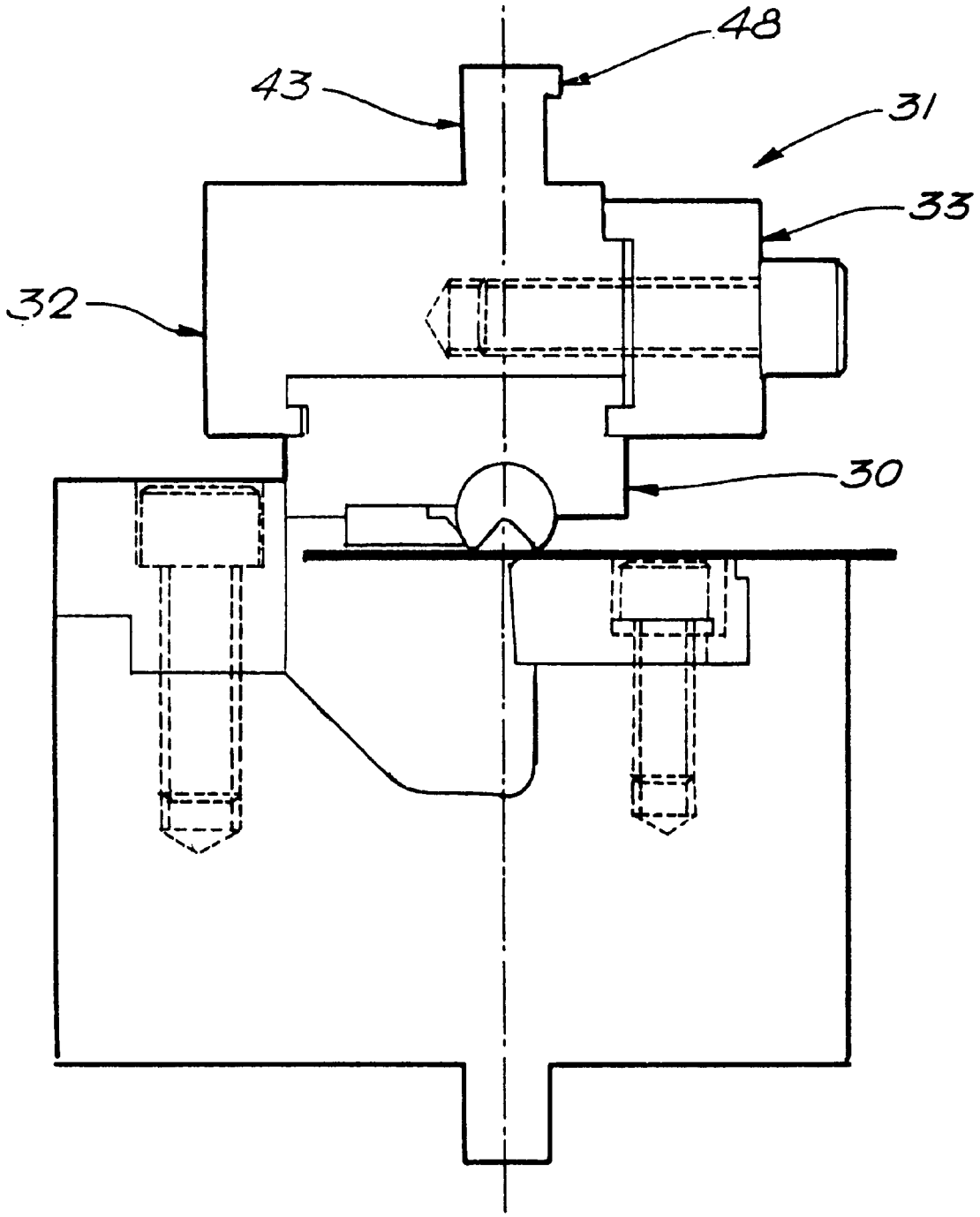
FIG. 5 is an end elevational view of the assembled rotary tool and tool holder of FIG. 3, positioned to initiate a bending operation.
Figure 6:
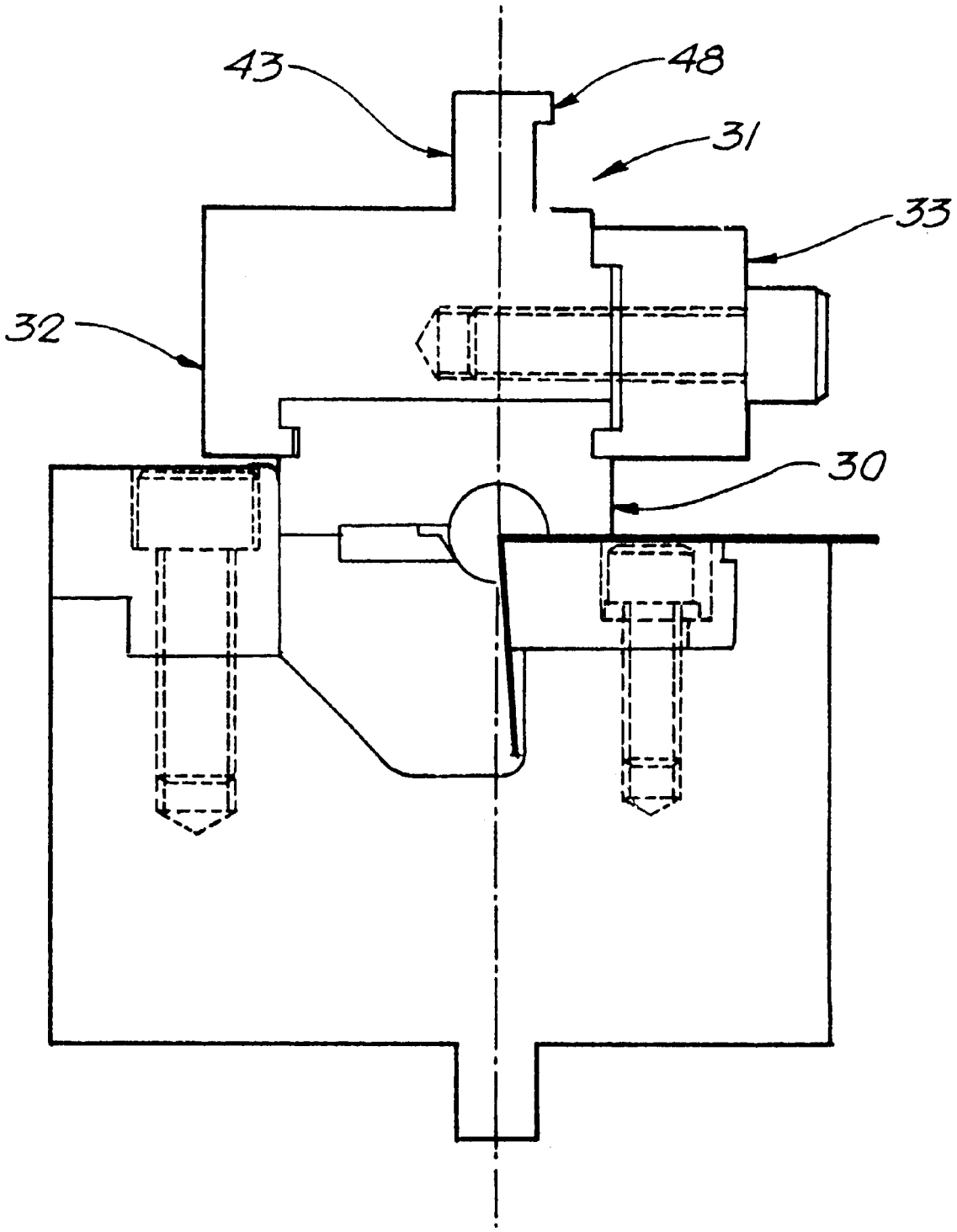
FIG. 6 is an additional end elevational view of the assembly seen in FIG. 5, but showing the rotary bending tool in operation to bend a fold in a sheet work piece.

FIGS. 5 and 6 demonstrate how a rotary bender mounted in its holder according to this invention is used in a metal forming application. From these figures it is amply clear how important it is that the rotary bender or a series of benders be held securely and precisely on the center line of the press brake.

Further it should be recognized how the present invention leads to the precise location and holding of multiple end to end benders in vast contrast to the present practice described heretofore. In addition, the rotary bending tool as exemplified in FIGS. 5 and 6 could be representative of a single tool having an overall length of 12', for example, which would require the mounting and alignment of no less than six separate pieces of bender tool according to a previous known practice.

Figure 7:
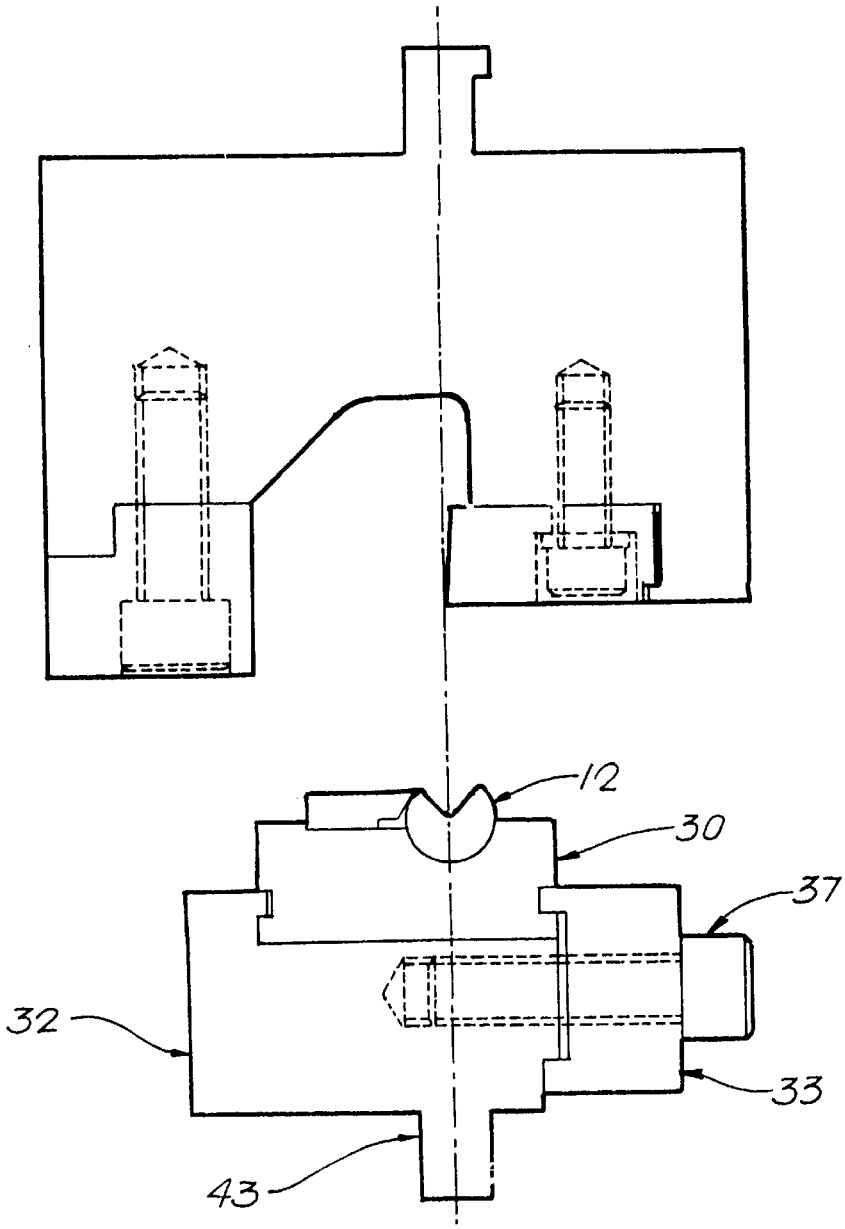
FIG. 7 is an end elevational view of the tool holder and rotary bending tool seen in FIG. 5, mounted in an alternate inverted position.

FIG. 7 illustrates the mounting of a precision rotary bender holder of this invention in an inverted position which is at times desirable in production. The only particular change necessary to the holder of FIG. 3 for such inverted mounting is the elimination of the safety hook 48 from the holder tang 43 (see FIGS. 3 and 4).

Figure 8:
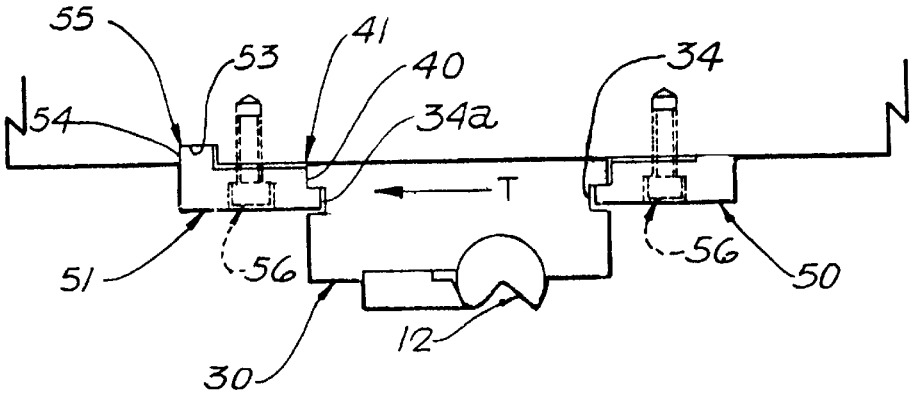
FIG. 8 is an end elevational view of a rotary bending tool mounted in a non-press brake die application according to this invention.

FIG. 8 shows the rotary bending tool 30 in a typical non-press brake application wherein the new improved holder locating and clamping system described hereinabove is employed.

As shown the rotary bending tool 30, is held firmly in place by two clamps 50 and 51 with tabs 35, 36 for engaging the opposing elongated lateral slots 34 and 34*a*. While the function of the clamp 50 is to hold the rotary bender 30 firmly in place, it is the dual function of the other clamp 51 to locate the bender in a precision position while also holding it firmly in place. During assembly the rotary bender 30 is either slidingly moved between the loosened clamps from either end or the preferred clamp 50 may be removed allowing the bender to be placed into its proper position after which the clamp is replaced and tightened in place by means of machine screws. During assembly, pressure is applied to the bender 30 in the direction of the arrow T, as set out in FIG. 8, forcing the bender's precision locating surface 40 firmly against the mating surface 41 of the clamp 51. Pressure exerted against the clamp 51 insures proper location of its extending tang 53 against mating surface 54 of a slot cut into the conventional die set or fixture at point 55, located at a known dimension from the center line of the rotary head 12. This insures proper placement and alignment of the bender. While constant pressure is being applied in the direction of the arrow T, the machine screws 56, of the two clamp members are systematically tightened.

It is believed that those skilled in the art will readily understand and recognize the advantages resulting from the herein disclosed novel system for locating and holding rotary bending tools of the type shown. This system provides for accurate, inexpensive and extremely flexible means for accurately locating and holding a rotary bending tool with no consideration or limitations imposed by the use of direct mounting screws or the like. As a result bending tools can be rapidly replaced, repositioned, expanded in length or even made up from multiple pieces of shorter length in a quick and convenient manner, utilizing the present invention. Die sets with broken mounting screws or taps will no longer present any particular problem because new holes can be added anywhere desirable in the clamps. This is not true in current rotary bender holder design where all the holes are held to precision dimensions and relocation may not be possible because of existing positions of gibs and return springs for a particular bender design.

From the foregoing it is submitted that those of skill in the art will readily recognize and appreciate the novel advancement of the present invention and that while the same has been herein disclosed in association with preferred and modified embodiments as described and illustrated in the accompanying drawings, the invention is nevertheless susceptible to wide variations, modification, substitutions of equivalents without departing from its spirit and scope which is intended to be unlimited by the foregoing except as may appear in the following appended claims.

The embodiments of the invention in which an exclusive property or privilege is claimed are defined as follows:

1. A holder for a rotary bending tool having a saddle block rotatably journaling a semi-cylindrical bending head, comprising:

a main body having a first reference surface and a first key extending from one side of said body;

said reference surface being at a prescribed distance from a selected center line of said body and said bending head;

a moveable clamp located adjacent a second side of said main body;

a second key extending from said clamp in spaced opposition to said first key; and means for moving said clamp relative to said main body whereby said first key and said second key engage opposite sides of said saddle block therebetween.

2. The holder of claim 1, wherein said first key and said second key are aligned to enter first and second keyways formed in said opposite sides of said saddle block.

3. The holder of claim 2, wherein said second key is engageable with the bottom of said second keyway in response to movement of said clamp toward said body.

4. The holder of claim 3, and a second reference surface on said saddle block at said prescribed distance from said center line; engagement of said second key with the bottom of said second keyway causing said second reference surface to engage said first reference surface whereby to position the center of said rotary bender at said prescribed distance.

5. The holder of claim 1, wherein said first key and said second key extend the full length of said bending tool.

6. A rotary bending tool holder mountable on a conventional fixture or die set, comprising:

clamp means engageable with opposite sides of a rotary bending tool;

opposing tab means extending from said clamp means for engaging recesses formed in said opposite sides of said bending tool, and for adjustably moving said clamp means to tightly engage and precisely position said bending tool.

* * * * *